US011015340B2

(12) United States Patent
Morrow

(10) Patent No.: US 11,015,340 B2
(45) Date of Patent: May 25, 2021

(54) SEALED ENVELOPE AGRICULTURAL BUILDING CONSTRUCTIONS

(71) Applicant: Blue Tomato LLC, Provo, UT (US)

(72) Inventor: Brian D. Morrow, Provo, UT (US)

(73) Assignee: Blue Tomato LLC, Provo, UT (US)

( * ) Notice: Subject to any disclaimer, the term of this patent is extended or adjusted under 35 U.S.C. 154(b) by 0 days.

(21) Appl. No.: 16/549,901

(22) Filed: Aug. 23, 2019

(65) Prior Publication Data

US 2021/0040733 A1 Feb. 11, 2021

Related U.S. Application Data

(60) Provisional application No. 62/722,591, filed on Aug. 24, 2018, provisional application No. 62/777,648, (Continued)

(51) Int. Cl.
*E04B 2/56* (2006.01)
*E04B 7/02* (2006.01)
(Continued)

(52) U.S. Cl.
CPC ..... *E04B 2/562* (2013.01); *E04B 1/66* (2013.01); *E04B 7/022* (2013.01); *E04B 7/026* (2013.01); *E04B 2/721* (2013.01)

(58) Field of Classification Search
CPC . E04B 2/562; E04B 1/66; E04B 7/022; E04B 2/721
See application file for complete search history.

(56) References Cited

U.S. PATENT DOCUMENTS 2,202,783 A 5/1940 Morrell
2,321,567 A 6/1943 Wilson
(Continued)

FOREIGN PATENT DOCUMENTS

DE 3034601 A1 * 4/1982 ..... E04H 5/08
FR 2359942 2/1978
(Continued)

OTHER PUBLICATIONS

U.S. Appl. No. 15/426,756, filed Feb. 7, 2017, Morrow.
(Continued)

*Primary Examiner* — Babajide A Demuren
(74) *Attorney, Agent, or Firm* — Workman Nydegger

(57) ABSTRACT

Agricultural barns, warehouses, and methods for construction including a floor, walls that include foam wall panels, a wainscot of impact resistant panels at a lower portion of the wall, and a ceiling formed from foam roof panels integrated into the roof truss assembly. Once the floor, walls, and ceiling are assembled, walls and ceiling can be coated over with an abrasion resistant, impact resistant polymeric coating (e.g., akin to a truck-bed liner), tying these structures together in a seamless shell that provides sufficient elasticity to accommodate typical expansion/contraction due to daily and seasonal heating/cooling, humidity changes, etc. The sealed interior envelope allows the interior surfaces to easily be pressure washed daily, or whenever else needed. Such construction is particularly well suited to an agricultural barn or warehouse, where cattle or forklifts may run into the lower portion of the walls, and pressure washing may be a daily need.

22 Claims, 5 Drawing Sheets

Related U.S. Application Data filed on Dec. 10, 2018, provisional application No. 62/890,818, filed on Aug. 23, 2019, provisional application No. 62/746,118, filed on Oct. 16, 2018.

(51) Int. Cl.
*E04B 1/66* (2006.01)
*E04B 2/72* (2006.01)

(56) References Cited

U.S. PATENT DOCUMENTS 3,284,980 A 11/1966 Dinkel
3,353,315 A 11/1967 George
3,374,703 A 3/1968 Davis et al.
3,517,468 A 6/1970 Woods
3,529,390 A 9/1970 Stetter
3,646,715 A 3/1972 Pope
3,699,731 A 10/1972 Arnold
3,775,916 A 12/1973 Bair
3,808,085 A 4/1974 Givens
4,035,972 A 7/1977 Timmons
4,435,928 A 3/1984 Huling
4,443,988 A 4/1984 Coutu, Sr.
4,578,909 A 4/1986 Henley et al.
4,578,915 A 4/1986 Schneller
4,615,448 A 10/1986 Johnstonbaugh
4,617,219 A 10/1986 Schupack
4,641,468 A 2/1987 Slater
4,774,794 A 10/1988 Grieb
4,893,451 A 1/1990 Valente
4,944,416 A 7/1990 Petersen
5,003,742 A 4/1991 Dettbarn
5,030,502 A 7/1991 Teare
5,062,387 A * 11/1991 Anderson ..... A01K 1/01 119/450
5,121,578 A 6/1992 Holz
5,138,803 A 8/1992 Grossen
5,172,532 A 12/1992 Gibbar
5,173,233 A 12/1992 Kafarowski
5,231,813 A 8/1993 Drawdy
5,268,226 A 12/1993 Sweeney
5,353,560 A 10/1994 Heydon
5,353,562 A 10/1994 Decker
5,377,470 A 1/1995 Hebinck
5,390,462 A 2/1995 Kreiter
D384,108 S 9/1997 Rinicella
5,694,730 A 12/1997 Del et al.
5,803,964 A 9/1998 Scarborough
5,822,940 A 10/1998 Carlin et al.
5,899,037 A 5/1999 Josey
5,901,522 A 5/1999 Slater
5,921,046 A 7/1999 Hammond, Jr.
5,927,032 A 7/1999 Record
5,950,389 A 9/1999 Porter
D444,577 S 7/2001 Neuhofer
6,305,135 B1 10/2001 Inaba
6,324,809 B1 12/2001 Nelson
6,460,302 B1 * 10/2002 Neuhaus, III ..... E04B 1/161 106/724
6,470,632 B1 10/2002 Smith
6,481,172 B1 11/2002 Porter
6,571,523 B2 6/2003 Chambers
D477,423 S 7/2003 Campbell
6,701,683 B2 3/2004 Messenger
6,772,890 B2 8/2004 Campbell
6,985,832 B2 1/2006 Saebi
7,028,440 B2 4/2006 Brisson
7,036,196 B2 5/2006 Salatin
7,093,726 B1 8/2006 Holztrager
7,165,374 B2 1/2007 Ohanesian
7,712,265 B2 5/2010 Overmyer
7,779,600 B1 8/2010 Saebi
7,913,730 B2 * 3/2011 Schaffeld ..... E04F 13/10 144/354
8,151,539 B2 * 4/2012 Grinsted ..... E04C 2/205 52/745.1
8,220,648 B2 7/2012 Barkdoll
8,468,767 B1 6/2013 McBride
8,627,625 B2 1/2014 Bouchard
8,695,299 B2 4/2014 Propst
9,234,355 B2 * 1/2016 Sealock ..... B32B 9/02
D861,194 S 9/2019 Morrow
10,450,736 B2 10/2019 Morrow
2005/0284060 A1 12/2005 Ritchie
2006/0046068 A1 * 3/2006 Barancyk ..... C08G 18/3821 428/423.1
2006/0207479 A1 9/2006 Hughes
2007/0131308 A1 6/2007 Martin
2008/0282632 A1 * 11/2008 Sleeman ..... B32B 27/08 52/309.1
2009/0100780 A1 4/2009 Mathis et al.
2010/0011699 A1 1/2010 Weimer et al.
2010/0083590 A1 4/2010 Wochnik
2010/0095625 A1 4/2010 Boutaghou et al.
2010/0136269 A1 6/2010 Andersen
2011/0067331 A1 3/2011 Grinsted
2011/0173911 A1 7/2011 Propst
2011/0214374 A1 9/2011 Propst
2012/0011793 A1 1/2012 Clark et al.
2013/0008129 A1 * 1/2013 Hall ..... D06N 3/14 52/782.1
2013/0086850 A1 * 4/2013 Morrow ..... E04C 2/06 52/167.1
2013/0216760 A1 8/2013 Bol
2013/0227902 A1 9/2013 Van et al.
2013/0266370 A1 10/2013 Gunther
2014/0250827 A1 9/2014 Gillman
2015/0135634 A1 * 5/2015 Hoie ..... B29C 44/3461 52/741.4
2016/0014995 A1 * 1/2016 Bruno ..... A01K 1/033 119/482
2016/0208489 A1 7/2016 Gibson
2017/0096825 A1 * 4/2017 Bree ..... B29C 45/40
2017/0121958 A1 * 5/2017 Jin ..... E04B 2/562
2017/0211268 A1 * 7/2017 Eichhorn ..... B32B 3/08
2018/0298600 A1 * 10/2018 Moss ..... E04C 2/388
2020/0001583 A1 * 1/2020 Eichhorn ..... B32B 21/14
2020/0354945 A1 11/2020 Morrow

FOREIGN PATENT DOCUMENTS

GB 2261234 5/1993
JP 07-102680 4/1995
JP 10148095 6/1998
JP 2002-292612 10/2002
KR 10-1993-0010328 6/1993
KR 10-2009-0065909 6/2009
WO 2013052427 4/2013
WO WO-2018194528 A1 * 10/2018 ..... C08J 9/33

OTHER PUBLICATIONS

U.S. Appl. No. 13/866,569, filed Apr. 19, 2013, Morrow.
U.S. Appl. No. 29/648,685, filed May 23, 2018, Morrow.
U.S. Appl. No. 29/658,417, filed Jul. 31, 2018, Morrow.
International Search Report for PCT/US2012/058344 dated Mar. 28, 2013,3 pages.
U.S. Appl. No. 13/436,403, Feb. 13, 2013, Office Action.
U.S. Appl. No. 13/436,403, Aug. 1, 2013, Final Office Action.
U.S. Appl. No. 13/866,569, Jun. 20, 2014, Notice of Allowance.
U.S. Appl. No. 15/426,756, Feb. 23, 2018, Office Action.
U.S. Appl. No. 29/648,685, Feb. 15, 2019, Ex Parte Quayle Action.
U.S. Appl. No. 29/648,685, May 9, 2019, Notice of Allowance.
Office Action received for U.S. Appl. No. 15/987,366, dated Feb. 14, 2019.
Office Action received for U.S. Appl. No. 16/709,674, dated Apr. 6, 2020.
U.S. Application filed on Aug. 23, 2019. by Morrow., U.S. Appl. No. 16/549,901.

(56) References Cited

OTHER PUBLICATIONS

U.S. Application filed on Mar. 19, 2020 by Morrow., U.S. Appl. No. 16/824,209.

* cited by examiner

SEALED ENVELOPE AGRICULTURAL BUILDING CONSTRUCTIONS

CROSS-REFERENCE TO RELATED APPLICATION

This application claims the benefit under 35 U.S.C. 119(e) of U.S. Provisional Application No. 62/722,591 (18944.13), filed Aug. 24, 2018, which is entitled SEALED ENVELOPE AGRICULTURAL BUILDING CONSTRUCTION; U.S. Patent Application No. 62/777,648 (18944.18), filed Dec. 10, 2018, which is entitled LIGHTWEIGHT POST AND BEAM CONSTRUCTION SYSTEM BASED ON HORIZONTALLY PRE-SLOTTED PANELS, U.S. Patent Application No. 62/890,818 (18944.18.1), filed Aug. 23, 2019, which is entitled LIGHTWEIGHT POST AND BEAM CONSTRUCTION SYSTEM BASED ON HORIZONTALLY PRE-SLOTTED PANELS; and U.S. Provisional Application No. 62/746,118 (18944.17), filed Oct. 16, 2018, which is entitled BELOW GRADE FLUID CONTAINMENT, each of which is herein incorporated by reference in its entirety.

BACKGROUND OF THE INVENTION

1. The Field of the Invention

The present invention is in the field of modular building construction methods and systems used within the construction industry, particularly those that can provide at least an interior environment that is sealed so as to be air-tight and/or water-tight.

2. The Relevant Technology

Building construction systems including modular features are sometimes used in the construction field. Particularly in third world countries where skilled labor is not readily available, and building materials must be relatively inexpensive, cinder block or brick materials are used in constructing homes, schools, agricultural buildings, and other buildings. It can be difficult to learn to lay block or brick while keeping the walls square and plumb. In addition, such systems require mortar to hold the individual blocks or bricks together. A roof formed from a different material (other than block or brick) is needed. In addition, insulating and/or providing an air-tight or water-tight seal within such structures is difficult. Such a sealed structure is particularly difficult to attain in existing agricultural barns or other warehouse constructions.

Various other building materials and systems are also used in the art. Structural insulated panels (SIPs) are used in some circumstances within the construction industry as an alternative to stick frame construction. A typical structural insulated panel may include an insulating layer sandwiched between two layers of structural plywood or oriented strand board ("OSB"). The use of such panels within various construction projects can often significantly decrease the time required for construction, and also typically provides superior insulating ability as compared to a traditional structure constructed of block or brick, or even stick frame construction with insulation blown or laid between frame members. Drawbacks associated with such systems is that SIP construction still requires skilled labor, shipping such panels can represent a significant expense, and the results are still not air-tight or water-tight. In addition, heavy equipment (e.g., cranes) are often required for installation. Furthermore, because the exterior skins of SIPs are formed of wood, they are subject to water damage, fire damage, and they present a food source for insects.

SUMMARY

The present invention is directed to building constructions, e.g., such as an agricultural barn, warehouse, or small shed (e.g., greenhouse, dog kennel, or storage shed) that can be easily and quickly constructed. Such structure may include a floor (e.g., concrete slab), and walls extending upward from the floor, comprising foam wall panels covered over with a wainscot of impact panels to provide the wainscot portion of the wall with impact resistance. The structure may also include a roof assembly, e.g., over the walls. The roof assembly may include roof trusses with foam roof panels attached between adjacent horizontal members of the roof trusses providing an interior ceiling. The foam roof panels of the interior ceiling may provide sufficient strength for a worker to walk on an opposite face of the foam roof panels, above the interior ceiling, in an attic space between the upward angled members of the roof trusses (defining the angled roof) and the interior ceiling below. The impact panels of the wainscot portion of the wall, a remaining portion of the wall above the wainscot portion of the roof assembly, and an interior face of the foam panels of the roof assembly are coated with a polymeric abrasion resistant and impact resistant coating that seals the interior space defined between the floor, the walls and the ceiling in a seamless, air-tight configuration such that the walls, floor and ceiling of the interior space can be washed down as needed, without leaking or otherwise causing damage (e.g., water damage) to the structure. For example, drywall and many wood-based materials in existing constructions, particularly where exteriorly exposed during such washing, would routinely be damaged.

Another embodiment is directed to a structure (e.g., an agricultural barn for housing cattle or other animals) comprising a sloped floor, walls extending upward from the sloped floor, comprising foam panels covered over with a wainscot of impact panels to provide the wainscot portion of the wall with impact resistance against goring or running into by cattle other animals. The structure further includes a roof assembly over the walls, the roof assembly including roof trusses with foam roof panels attached between adjacent horizontal members of the roof trusses providing an interior ceiling, the foam roof panels of the interior ceiling providing sufficient strength for a worker to walk on an opposite surface of the foam roof panels, above the interior ceiling, in an attic space. The impact panels of the wainscot portion, the remaining portion of the wall above the wainscot portion to the roof assembly, an interior face of the foam panels of the roof assembly, and an interface between the sloped floor and the walls may be coated with a polymeric, abrasion resistant and impact resistant coating that seals the interior space defined between the sloped floor, the walls and the ceiling in a seamless, air-tight, water-tight configuration such that the walls, floor and ceiling of the interior space can be washed down as needed, without leaking or otherwise causing damage.

Another embodiment is directed to a structure (e.g., an agricultural barn or warehouse), where the interior space of the structure is under negative pressure to allow pull-through filtration of the interior space, the structure including a floor, and walls extending upward from the floor comprising foam wall panels covered over with a wainscot of impact panels to provide the wainscot portion of the wall with impact resistance. A roof assembly over the walls, including roof trusses with foam roof panels attached between adjacent lower horizontal members of the roof trusses (e.g., generally triangular) provide an interior ceiling to the interior space where the foam roof panels of the interior ceiling provide sufficient strength for a worker to walk on an opposite surface of the foam panels above the interior ceiling, in an attic space. The impact panels of the wainscot portion of the wall, a remaining portion of the wall above the wainscot portion to the roof assembly, and the interior ceiling can be coated with a polymeric abrasion resistant and impact resistant coating that seals the interior space defined between the floor, walls, and ceiling in a seamless air-tight, water-tight configuration so that the interior space can be negatively pressurized to allow pull-through filtration of the interior space, without any significant leaks. In addition, the walls, floor, and ceiling of the interior space can be washed down as needed, without leaking or otherwise causing damage.

Another embodiment is directed to a method for constructing structures such as those described herein. For example, such a method may include providing a floor, constructing walls extending upward from the floor, the walls comprising foam wall panels, covering over a lower portion of the foam wall panels with impact panels so as to form a wainscot that provides impact resistance to the lower portion of the walls, constructing a roof assembly over the walls, the roof assembly including roof trusses with foam roof panels attached between adjacent lower horizontal members of the roof trusses providing an interior ceiling to an interior space of the structure, the foam roof panels of the interior ceiling providing sufficient strength for a worker to walk on an opposite surface of the foam roof panels, above the interior ceiling, in an attic space. The impact panels of the wainscot, a remaining portion of the wall above the wainscot portion to the ceiling, and the interior ceiling may be coated with a polymeric, abrasion resistant and impact resistant coating so as to seal the interior space defined between the floor, the walls, and the ceiling in a seamless air-tight, water-tight configuration such that the interior space can (a) be negatively pressurized to allow pull through filtration of the interior space without leaks, and (b) the walls, floor, and ceiling of the interior space can be washed down as needed, without leaking or otherwise causing structural damage.

Another embodiment is directed to a small shed (e.g., for use as a greenhouse, dog kennel, storage shed, or the like) that is at least 10 $ft^2$, but less than about 100 $ft^2$. Such a shed comprises a floor, walls extending upward from the floor comprising foam wall panels, a roof assembly over the walls, the roof assembly including foam roof panels providing an interior ceiling. The interior surface of the walls, an interior face of the foam panels of the roof assembly, and the floor may be coated with a polymeric abrasion resistant and impact resistant coating that seals the interior space defined between the floor, the walls, and the ceiling in a seamless configuration such that the walls, floor and ceiling of the interior space can be washed down as needed, without leaking or otherwise causing damage. The exterior surfaces of the walls and any interior eaves may also be coated with the polymeric coating, such that the entire shed is of a monocot structure. Such a shed, because of the use of lightweight foam panels in the construction, may weigh less than about 300 lbs total.

Features from any of the disclosed embodiments may be used in combination with one another, without limitation. In addition, these and other benefits and features of the present invention will become more fully apparent from the following description and appended claims or may be learned by the practice of the invention as set forth hereinafter.

BRIEF DESCRIPTION OF DRAWINGS

To further clarify the above and other advantages and features of the present invention, a more particular description of the invention will be rendered by reference to specific embodiments thereof which are illustrated in the appended drawings. It is appreciated that these drawings depict only illustrated embodiments of the invention and are therefore not to be considered limiting of its scope. The drawings illustrate several embodiments of the invention, wherein identical reference numerals refer to identical or similar elements or features in different views or embodiments shown in the drawings.

DETAILED DESCRIPTION OF THE PREFERRED EMBODIMENTS

I. Definitions

Figure 1:
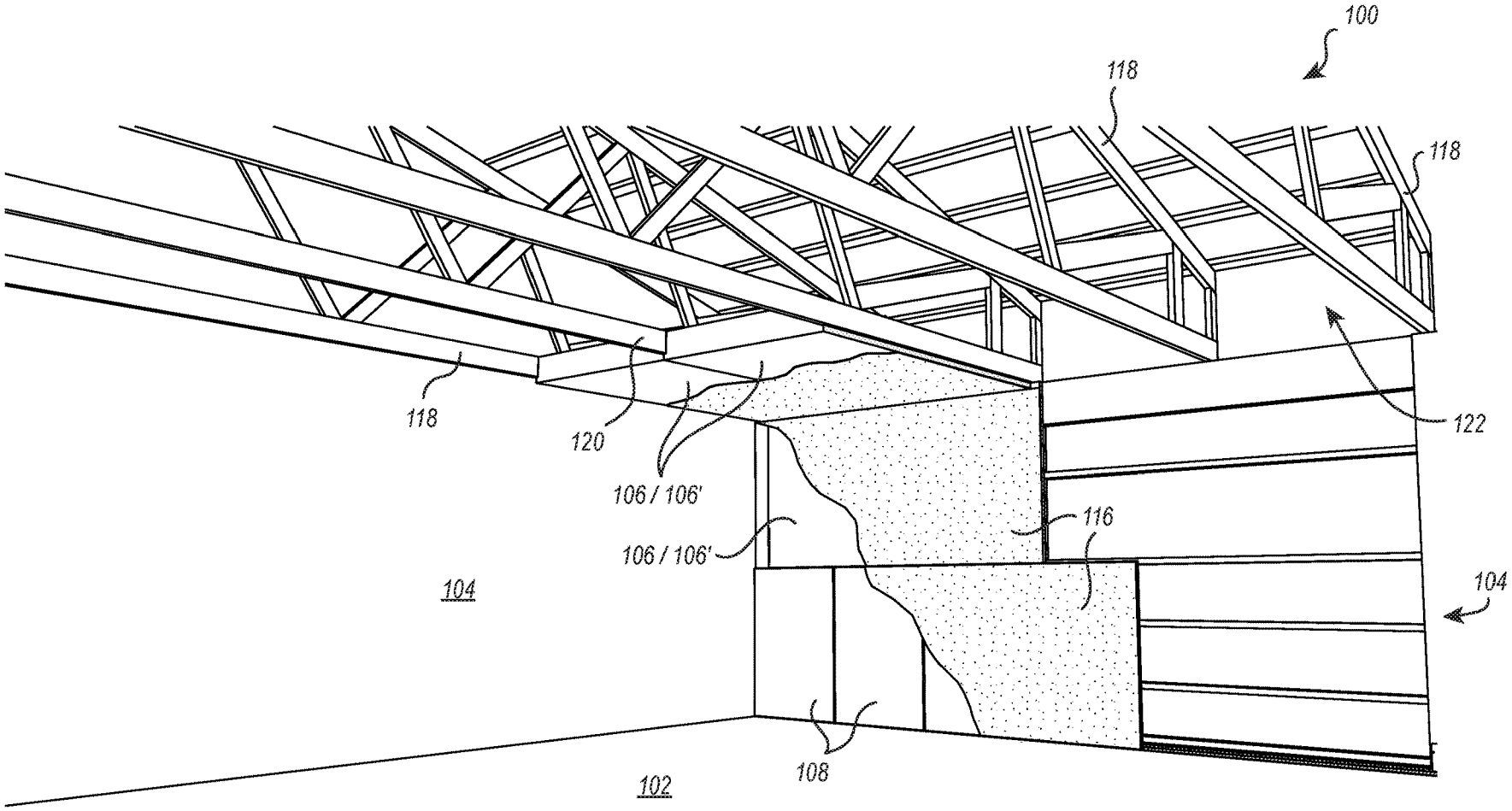
FIG. 1 illustrates an exemplary construction scheme according to the present invention.

All publications, patents and patent applications cited herein, whether supra or infra, are hereby incorporated by reference in their entirety to the same extent as if each individual publication, patent or patent application was specifically and individually indicated to be incorporated by reference.

Before describing the present invention in detail, it is to be understood that this invention is not limited to particularly exemplified systems or process parameters that may, of course, vary. It is also to be understood that the terminology used herein is for the purpose of describing particular embodiments of the invention only, and is not intended to limit the scope of the invention in any manner.

The term "comprising" which is synonymous with "including," "containing," or "characterized by," is inclusive or open-ended and does not exclude additional, unrecited elements or method steps.

The term "consisting essentially of" limits the scope of a claim to the specified materials or steps "and those that do not materially affect the basic and novel characteristic(s)" of the claimed invention.

The term "consisting of" as used herein, excludes any element, step, or ingredient not specified in the claim.

It must be noted that, as used in this specification and the appended claims, the singular forms "a," "an" and "the" include plural referents unless the content clearly dictates otherwise.

Numbers, percentages, ratios, or other values stated herein may include that value, and also other values that are about or approximately the stated value, as would be appreciated by one of ordinary skill in the art. As such, all values herein are understood to be modified by the term "about". A stated value should therefore be interpreted broadly enough to encompass values that are at least close enough to the stated value to perform a desired function or achieve a desired result, and/or values that round to the stated value. The stated values include at least the variation to be expected in a typical manufacturing process, and may include values that are within 10%, within 5%, within 1%, etc. of a stated value. Furthermore, where used, the terms "substantially", "similarly", "about" or "approximately" represent an amount or state close to the stated amount or state that still performs a desired function or achieves a desired result. For example, the term "substantially" "about" or "approximately" may refer to an amount that is within 10% of, within 5% of, or within 1% of, a stated amount or value.

Some ranges may be disclosed herein. Additional ranges may be defined between any values disclosed herein as being exemplary of a particular parameter. All such ranges are contemplated and within the scope of the present disclosure.

In some embodiments, the compositions or articles described herein may be free or substantially free from any specific components not mentioned within this specification.

Unless defined otherwise, all technical and scientific terms used herein have the same meaning as commonly understood by one of ordinary skill in the art to which the invention pertains. Although a number of methods and materials similar or equivalent to those described herein can be used in the practice of the present invention, the preferred materials and methods are described herein.

II. Exemplary Systems

In one embodiment, the present invention is directed to structures, such as agricultural barns, warehouses, or sheds or small structures (e.g., less than about 100 $ft^2$) that may be constructed in a manner where the interior surfaces provide a sealed interior envelope, accomplished using simple construction techniques. An exemplary structure 100 may be such as that seen in FIG. 1, including a floor 102, walls 104 extending upwardly from the floor 102, where the walls 104 comprise foam wall panels 106 that may be covered with a wainscot of impact panels 108 to provide the wainscot portion of the wall 104 with increased impact resistance. By way of example, the foam wall panels, and the wall construction may be according to Applicant's U.S. patent application Ser. No. 15/987,366 (18944.10.2); Ser. No. 29/648,685 (18944.11); 62/777,648 (18944.18), and/or 62/890,818 (18944.18.1), each of which is incorporated herein by reference in its entirety. It will be appreciated that such a wall construction is simply preferred, and that other wall constructions are of course also possible.

Figure 2A:
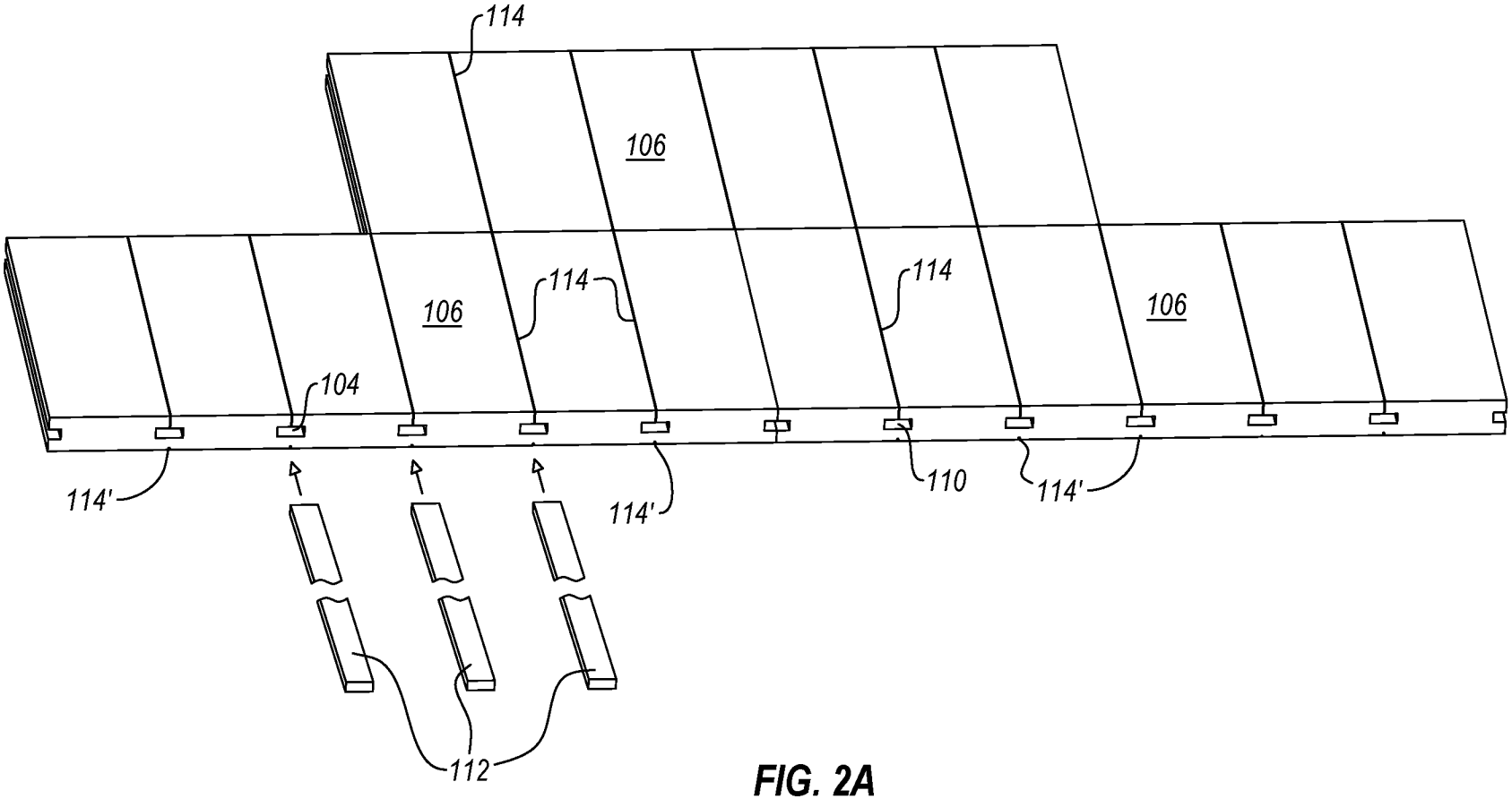
FIG. 2A illustrates an exemplary wall construction.

By way of example, FIG. 2A shows an exemplary foam wall panel wall construction employing foam wall panels 106 such as those described in Applicant's U.S. patent application Ser. No. 15/987,366 (18944.10.2), already incorporated by reference in its entirety. Such panels include a foam body, and a plurality of channels 110 extending through a length or width of the panel 106, each channel being configured to receive a spline 112 therein, wherein each spline once received in the channel is disposed within the foam body, without the spline 112 being exposed on an outside face of the body, so that the spline 112 is restrained once received within the channel 110. The foam body is generally rectangular in shape, and includes pre-cut slots 114 in a first face of the panel, each pre-cut slot 114 being centered on a respective channel 110, extending through the first face into such channel 110. The foam body further includes a score line 114' or another pre-cut slot in an opposite face of the panel, aligned with the pre-cut slot 114 in the first face. The thickness of the foam beneath the score line 114' (or adjacent a pre-cut slot, if present instead of score line 114') is less than half the thickness of the foam body defined between the first face (where precut slot 114 is) and the second face (where the score line 114' or another precut slot is). In the wall of FIG. 2A, the splines are shown as oriented vertically.

Figure 2B:
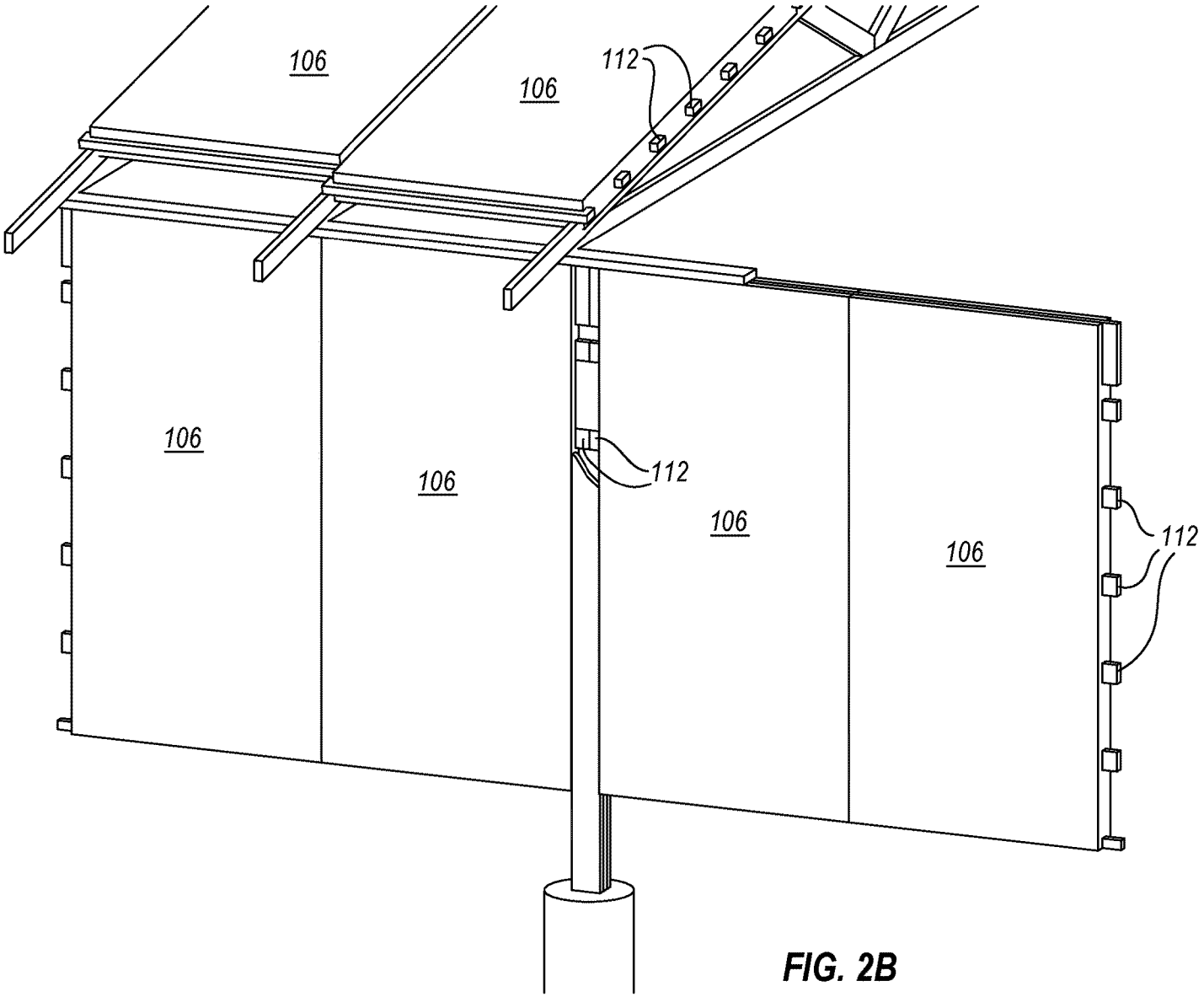
FIG. 2B illustrates another exemplary wall construction.
Figure 2C:
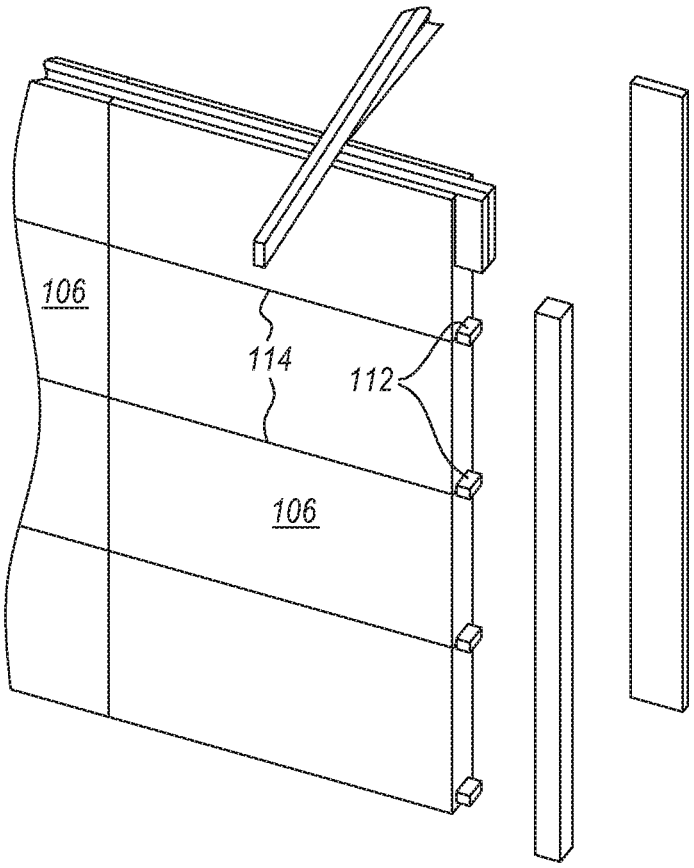
FIG. 2C illustrates another exemplary wall construction.

FIGS. 2B and 2C illustrate additional possible wall configurations, also described in Applicant's U.S. patent application Ser. No. 15/987,366 (18944.10.2), but in which the panels are alternately oriented so that splines 112 are oriented horizontally. It will be apparent that a wide variety of wall constructions are possible, e.g., using foam panels such as those described in Applicant's other filings, or otherwise.

Figure 3:
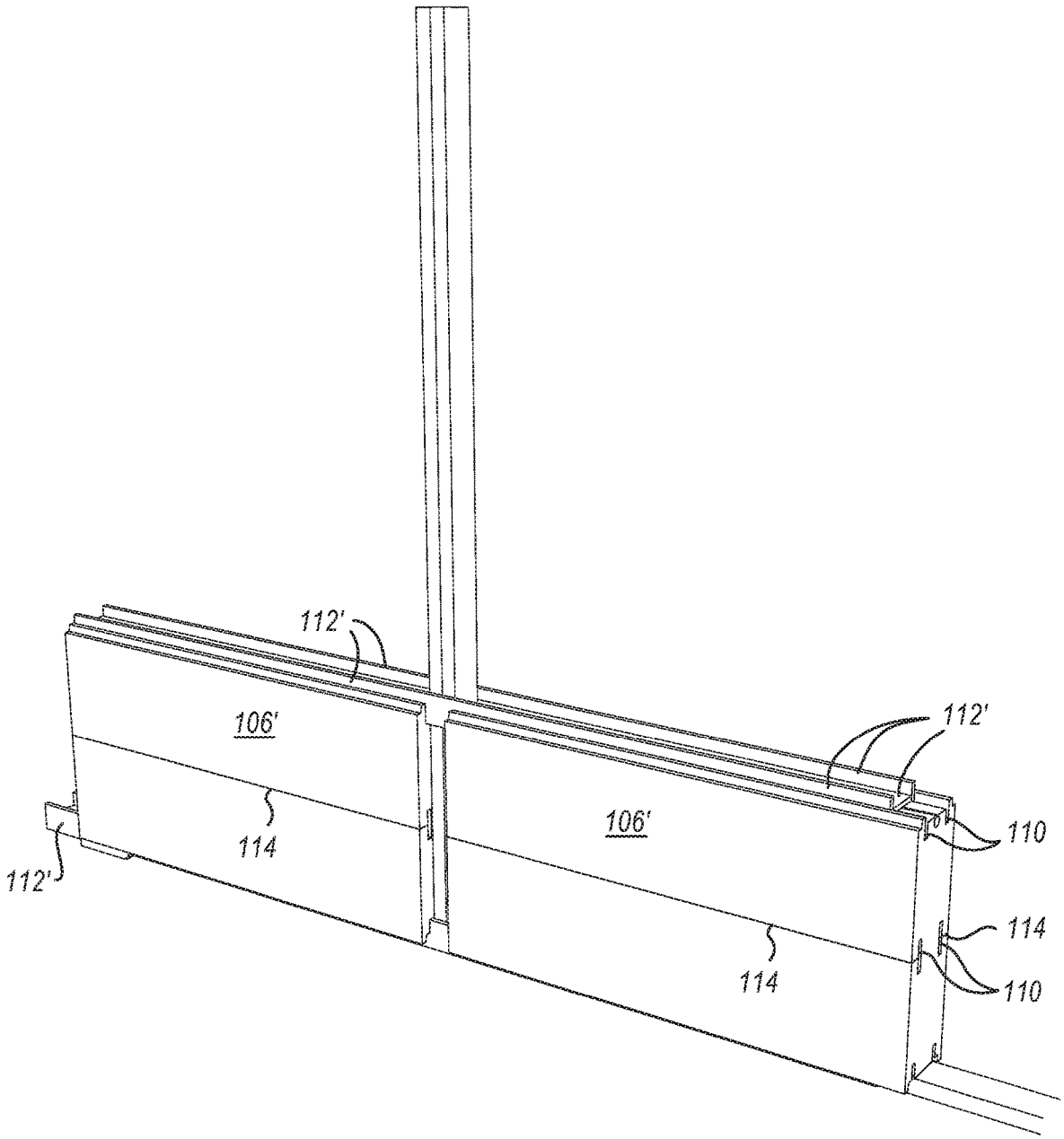
FIG. 3 illustrates another exemplary wall construction.

FIG. 3 illustrates another possible wall configuration, based on the foam panel and wall construction system described in Applicant's U.S. Patent Application No. 62/777,648 (18944.18) and 62/890,818 (18944.18.1), already incorporated by reference in its entirety. Such foam panels 106' are similar to those of Applicant's U.S. patent application Ser. No. 15/987,366 (18944.10.2), including a generally rectangular foam body, having a plurality of channels disposed therethrough. The foam panel configuration seen in FIG. 3 is oriented with the channels for receipt of splines 112' in a horizontal direction, where the splines between adjacent stacked panels are not exposed on a the major exterior planar faces of the panels, but are encased and restrained within the channel spaces, between adjacent stacked panels. The illustrated horizontal splines may be configured as I-beams, e.g., formed in-situ by placement of the two flanges and the web of such an I-beam, as shown. Additional channels within the foam body are also shown, e.g., which may allow insertion of splines therein that may further serve as furring strips. It will be apparent that a variety of wall configurations and foam panel configurations may be possible when constructing such a wall 104, such that the described embodiments are merely exemplary.

In any case, returning to FIG. 1, a wainscot of impact panels 108 may be installed along the lower portion of the wall 104. The wainscot impact panels 108 may be cementitious panels such as those described in Applicant's U.S. patent application Ser. No. 15/426,756 (18944.9), incorporated by reference in its entirety. Application Ser. Nos. 13/866,569 and 13/436,403, which are incorporated by reference in U.S. patent application Ser. No. 15/426,756 (18944.9), are also incorporated by reference herein in their entirety. Such impact panels 108 provide greatly improved impact resistance to the lower portion of the wall 104, as compared to the underlying foam wall panels 106, 106', or as compared to the top portion of the wall 104, which may not necessarily be tiled over with such impact panels 108. Such increased impact resistance will be greatly advantageous in an agricultural barn meant to house cattle, hogs, or other animals that may routinely ram into the lower portions of the walls of the barn. Such impact resistance will be similarly beneficial in a warehouse, where the same lower portion of the wall may be bumped into by a forklift, etc. Without such impact panels, the foam wall construction may be damaged or breached after repeated ramming, bumping, goring, etc.

Such wainscot impact panels 108 are not necessarily required, e.g., in the small shed configuration, or where the abrasion resistant, impact resistant coating 116 is simply applied somewhat thicker along the lower portion of the wall 104, as compared to the upper wall portion. For example, where cattle or other large animals are being housed, or in a warehouse, the impact panels 108 may very well be desired, but in a small shed, e.g., used as a dog kennel or greenhouse, there may not be the same need for impact resistance. In such a configuration, the spray applied coating 116 may provide sufficient impact resistance to the foam panels 106, 106' at the core of the wall structure. By way of example, the coating thickness may be greater than 5 mils, and up to 500 mils, although typically no more than 150 mils would be needed (e.g., 6 mils to 150 mils, or 6 mils to 30 mils).

FIG. 1 further shows how the roof system may include roof trusses, with foam roof panels being inserted between adjacent horizontal members of the roof trusses 118. Such foam roof panels 106, 106' may thus also provide the interior ceiling for the structure. The foam roof panels 106, 106' may be notched at their edges to accommodate the horizontal truss members 120 of generally triangular trusses 118, while at the same time entirely covering the horizontal truss members 120 with foam, as shown. The notch allows nailing of the foam roof panels into the underside of the horizontal truss members 120. The notched edges of the foam roof panels may also have a urethane or similar construction adhesive applied thereto, to permanently fix the foam roof panels in place between the adjacent trusses 120. Small structure constructions may of course not necessarily include any roof trusses, but may still include roof foam panels.

It will be apparent that a relatively thick foam panel (e.g., 6 inches or more, such as 8 to 12 inches) will then provide a strong surface above the interior space, in the illustrated attic space within the trusses. This surface will be strong enough to allow workers or others to walk on the top surface of the foam roof panels 106, 106', without fear of breaking through. This will also allow easy installation of air conditioning, electrical, plumbing, or other components in the attic space 122. Such equipment can easily be accessed and fully supported by the foam roof panels, without fear of breaking through the ceiling. Small structure construction roof foam panels may similarly provide sufficient strength for walking on.

The foam roof panels (e.g., expanded polystyrene, like the other foam panels of the walls and/or floor) may have a density 1 $lb/ft^3$ or greater (e.g., but less than 10 $lb/ft^3$, or less than 5 $lb/ft^3$). The other foam panels may similarly have a density of about 1 $lb/ft^3$, or somewhat greater (e.g., such as those values noted above). The foam panels may be nailed and/or glued at the notched edges and/or elsewhere to the trusses.

As shown in FIG. 1, any wainscot (lower region covered by panels 108) and the remaining upper portion of the foam walls 104, and the foam roof panels are finally overcoated with an abrasion resistant, impact resistant coating 116, such as a two-part polymeric composition. Examples of such include curable polyurethanes and curable polyureas. Such coating also exhibits some degree of elasticity, which is sufficient that the coating does not crack or otherwise fail over years of use, even when exposed to daily and seasonal temperature, humidity, and other environmental changes. Such a coating may be similar to a truck-bed liner material. The coating may also exhibit non-stick properties, such that dirt, soil, blood, or other materials are easily washed off the coating by simply pressure washing the surface. In an agricultural barn, dog kennel or the like, such pressure washing may be a daily occurrence.

Because of the applied once-piece coating 116, there are no seams or joints that are exposed in the coated boundary of the walls, and ceiling (all of which may be coated with a single piece coating). The interface between the walls 104 and the floor 102 may also be coated, or otherwise sealed. This coating seal allows the interior space of the structure to easily be pressurized, or more particularly, subjected to a negative pressure, without risk of leaks from the exterior, through the sealed floor, walls, and ceiling. Such a sealed construction is quite different from existing agricultural and warehouse constructions, where any attempt to negatively pressurize the building (i.e., dropping the internal pressure below atmospheric pressure) results in air seeping in through various tiny cracks and joints throughout the construction, as traditional constructions do not provide a sealed coating or even a sealed interior, as described herein. Because of these difficulties in sealing the structure, buildings are typically provided with positive pressure.

Such negative pressure would allow the building to operate a more efficient filtration system, which could rely on pull-through filtration, rather than a push-through configuration, as is traditionally required. In other words, normally a building is pressurized, which requires significant energy consumption. It actually requires significantly less energy to subject the same interior building space to negative pressure, if the building could be well sealed. The present system provides the necessary sealing of the building interior. Such a difference could save a typical farm of agricultural barns tens of thousands of dollars each year, in energy and filtration costs, alone. Using a negative pressure filtration system allows filtration to be achieved with far lower air flow, and energy use to filter the same given building volume. This greatly decreases energy costs and filtration costs.

The coated interior also facilitates easy pressure washing of all the interior surfaces, and because of the non-stick characteristics of the coating, such washing is far easier than attempting to wash conventional construction wall surfaces such as concrete, stucco, and the like. The foam panels being used are typically provided precut, as rigid foam sheet panels, exhibiting near perfect planar characteristics, rather than a spray-in type foam, as described in application Ser. No. 15/987,366 (18944.10.2). The rigid, pre-cut, planar characteristics of the foam panels of the walls, ceiling, and optionally even the floor (i.e., a foam panel floor) ensure that the foam panels are flat, which aids in creating an easy to clean surface. This is not the case with spray-in expandable foam, which does not result in a planar wall face. For example, spray-in foam walls result in crevices and a macro texture which tends to collect soils and the like, making such a surface far more difficult to clean.

For example, as described in Applicant's applications already incorporated by reference, the foam panels are typically cut to an accuracy of 0.001 inch (i.e., 1 mil). Thus, the planar surface may have low surface roughness (e.g., less than 0.1 inch, less than 0.01 inch, or no more than 0.001 inch variability in the "normal" direction relative to the plane). Such is not achievable with spray-in expandable construction foams.

Even though the final exterior coating is applied by spraying, e.g., this surface is relatively thin, and is able to maintain the substantially planar characteristics of the underlying foam, even as the coating is sprayed thereover, e.g., in a similar manner as a coating of paint.

Any doors provided into the structure could similarly be sealed around and coated with the same coating, providing excellent resistance against impact and abrasion, clawing, chewing, etc.

A pressure washing system could even be integrated into the building, e.g., where at the push of a button, the interior of the building could be pressure washed, much like a giant dishwasher.

The floor may be constructed of floor foam panels, similar to those of the walls and/or ceilings, if desired. In another embodiment, a concrete floor could be provided. In any case, the interface between the walls and the floor is sealed, e.g., by coating with the same polyurethane or other abrasion resistant impact resistant coating as applied to the ceiling and walls, tying all these structures together into a single piece structure. In the case where the exterior surfaces are also coated (e.g., in the case of a dog kennel or the like), the entire building itself becomes a monocot structure, acting as a monocot, integral single structure, rather than an assembly of separate walls, floor, and roof (which can be separated and break apart at their attachment points).

In addition to use in agricultural barns or warehouses, the construction could be used in other similar configurations where such benefits of abrasion resistance, easy power washing of the interior and the like may be beneficial. One such example would be in small shed construction (e.g., less than about 100 $ft^2$, such as from 10 $ft^2$ to 100 $ft^2$, or 25 $ft^2$ to 100 $ft^2$, or 50 $ft^2$ to 100 $ft^2$). For example, a 8'×8' shed may easily weight less than 300 lbs (e.g., about 250 lbs), when constructed as described herein. Such a small shed could easily be lifted and moved by two people. Conventional construction methods for a similar shed typically result in a weight more like 1000 lbs. Such cannot easily be moved by two people by hand. In addition, conventionally constructed sheds can be damaged when attempting to move them, as the walls, floor, or roof structures may begin to come apart at the attachment points, because these components are not tied together in a monocot structure, as the present small sheds would be, as a result of the applied coating. Such small sheds, particularly very small ones, such as a dog kennel, may not use roof trusses, but may employ any desired roof assembly, particularly one that is formed from foam roof panels.

Such structures may be particularly suitable for use as a greenhouse, dog kennels or the like. It would be easy to pressure wash (or self-wash) such a dog kennel, with a slopped floor. Where the inside and outside (e.g., walls, floors, ceilings, etc. are coated). In a very small shed structure, the entire floor (not just the floor/wall interface) may be coated. Such monocot structures can be moved as a single piece, without damage to the floor, walls, or roof components, because of the impact resistant, abrasion resistant, elastic interior coating tying everything together. Such small sheds could be placed on a skid or provided with a hook or the like for easily moving them from place to place, as needed.

It will also be appreciated that the present claimed invention may be embodied in other specific forms without departing from its spirit or essential characteristics. The described embodiments are to be considered in all respects only as illustrative, not restrictive. The scope of the invention is, therefore, indicated by the appended claims rather than by the foregoing description. All changes that come within the meaning and range of equivalency of the claims are to be embraced within their scope.

What is claimed is:

1. An agricultural barn for housing cattle or other animals, or a warehouse comprising:

a floor;

walls extending upward from the floor, comprising foam wall panels covered over with a wainscot of impact panels to provide the wainscot portion of the wall with impact resistance;

a roof assembly over the walls, the roof assembly including roof trusses with foam roof panels attached between adjacent horizontal members of the roof trusses providing an interior ceiling, the foam roof panels of the interior ceiling providing sufficient strength for a worker to walk on an opposite surface of the foam roof panels, above the interior ceiling, in an attic space, wherein the foam roof panels comprise rigid foam insulation with 1 $lb/ft^3$ or greater density foam, where the foam is notched at the edges thereof for easy attachment between trusses, the foam roof panels being attached to the trusses;

wherein the (i) impact panels of the wainscot portion of the wall, (ii) a remaining portion of the wall above the wainscot portion to the roof assembly, and (iii) an interior face of the foam panels of the roof assembly are coated with a polymeric, abrasion resistant, and impact resistant seamless coating that seals the interior space defined between the floor, the walls, and the ceiling in a seamless, air-tight configuration such that the walls, floor, and ceiling of the interior space can be washed down as needed, without leaking or otherwise causing damage.

2. An agricultural barn or warehouse as recited in claim 1, wherein an interface between the walls and the floor is also coated with the polymeric, abrasion resistant and impact resistant seamless coating.

3. An agricultural barn or warehouse as recited in claim 1, wherein the coating comprises a two-part curable composition.

4. An agricultural barn or warehouse as recited in claim 3, wherein the two-part curable composition is a two-part polyurethane coating or a two-part polyurea coating.

5. An agricultural barn or warehouse as recited in claim 4, wherein the two-part polyurethane coating or two-part polyurea coating is applied to have a thickness greater than 5 mils.

6. An agricultural barn or warehouse as recited in claim 5, wherein the two-part polyurethane coating or two-part polyurea coating is applied to have a thickness from 6 to 150 mils.

7. An agricultural barn or warehouse as recited in claim 5, wherein the two-part polyurethane coating or two-part polyurea coating is applied to have a thickness from 6 to 30 mils.

8. An agricultural barn or warehouse as recited in claim 1, wherein the polymeric coating is elastomeric, providing sufficient elasticity upon curing so that it does not crack over time, such that no accommodation for expansion joints or seams is required in the barn or warehouse.

9. An agricultural barn or warehouse as recited in claim 4, wherein the two-part polyurethane coating or two-part polyurea coating provides sufficient elasticity upon curing so that it does not crack over time, such that no accommodation for expansion joints or seams is required in the barn or warehouse.

10. An agricultural barn or warehouse as recited in 9, wherein the two-part polyurethane coating or two-part polyurea coating provides non-stick properties.

11. An agricultural barn or warehouse as recited in claim 1, wherein the walls are constructed using a system of modular foam panels and splines, wherein the modular foam panels comprise:

a body;

a plurality of channels extending through a length or width of the panel, each channel being configured to receive a spline therein, wherein each spline once received in the channel is disposed within the body, without the spline being exposed on an outside face of the body, so that the spline is restrained once received within the channel;

wherein the body comprises foam, and the foam body is generally rectangular in shape.

12. An agricultural barn or warehouse as recited in claim 1, wherein the floor is sloped, so that upon washing the walls, floor, or ceiling, the wash water drains towards a drain in the sloped floor.

13. An agricultural barn or warehouse as recited in claim 1, wherein foam roof panels are nailed and glued to the trusses.

14. A structure that is an agricultural barn for housing cattle or other animals, or a warehouse, wherein an interior space of the structure is under negative pressure to allow pull-through filtration of the interior space, the structure comprising:

a floor;

walls extending upward from the floor, comprising foam wall panels covered over with a wainscot of impact panels to provide the wainscot portion of the wall with impact resistance;

a roof assembly over the walls, the roof assembly including roof trusses with foam roof panels attached between adjacent lower horizontal members of the roof trusses providing an interior ceiling to the interior space, the foam roof panels of the interior ceiling providing sufficient strength for a worker to walk on an opposite surface of the foam roof panels, above the interior ceiling, in an attic space;

wherein the (i) impact panels of the wainscot portion of the wall, (ii) a remaining portion of the wall above the wainscot portion to the roof assembly, and (iii) the interior ceiling are coated with a polymeric, abrasion resistant, and impact resistant coating that seals the interior space defined between the floor, the walls, and the ceiling in a seamless, air-tight configuration such that the interior space can be negatively pressurized to allow pull-through filtration of the interior space without leaks, and such that the walls, floor, and ceiling of the interior space can be washed down as needed, without leaking or otherwise causing damage.

15. A method for constructing a structure that is an agricultural barn for housing cattle or other animals, or a warehouse, the method comprising:

providing a floor;

constructing walls extending upward from the floor, the walls comprising foam wall panels;

covering over a lower portion of the foam wall panels with impact panels, so as to form a wainscot that provides impact resistance to the lower portion of the walls;

constructing a roof assembly over the walls, the roof assembly including roof trusses with foam roof panels attached between adjacent lower horizontal members of the roof trusses providing an interior ceiling to an interior space of the structure, the foam roof panels of the interior ceiling providing sufficient strength for a worker to walk on an opposite surface of the foam roof panels, above the interior ceiling, in an attic space, wherein the foam roof panels comprise rigid foam insulation with 1 lb/ft$^3$ or greater density foam, where the foam is notched at the edges thereof for easy attachment between trusses, the foam roof panels being attached to the trusses;

coating the (i) impact panels of the wainscot of the wall, (ii) a remaining portion of the wall above the wainscot portion to the ceiling, and (iii) the interior ceiling with a polymeric, abrasion resistant, and impact resistant coating so as to seal the interior space defined between the floor, the walls, and the ceiling in a seamless, air-tight configuration such that the interior space can (a) be negatively pressurized to allow pull-through filtration of the interior space without leaks, and (b), the walls, floor, and ceiling of the interior space can be washed down as needed, without leaking or otherwise causing structural damage.

16. A method as recited in claim 15, wherein an interface between the walls and the floor is also coated with the polymeric, abrasion resistant and impact resistant coating.

17. A method as recited in claim 15, wherein the polymeric coating is elastomeric.

18. A small shed for use as a greenhouse, dog kennel, or storage shed, that is at least 10 ft$^2$ and less than about 100 ft$^2$, comprising:

a floor;

planar walls extending upward from the floor, comprising rigid planar, generally rectangular foam wall panels;

a roof assembly over the walls, the roof assembly including rigid planar foam roof panels providing an interior ceiling;

wherein the (i) interior surface of the walls, (ii) an interior face of the foam panels of the roof assembly, and (iii) optionally the floor, are coated with a polymeric, abrasion resistant, and impact resistant coating that seals the interior space defined between the floor, the walls, and the ceiling in a seamless configuration such that the walls, floor, and ceiling of the interior space can be washed down as needed, without leaking or otherwise causing damage, wherein the polymeric, abrasion resistant, and impact resistant coating seals the interior space in a seamless, air-tight configuration such that the interior space can be negatively pressurized to allow pull-through filtration of the interior space without leaks;

wherein the exterior surfaces of the walls and any exterior eaves are also coated with the polymeric, abrasion resistant, impact resistant coating, such that the entire small shed is of a monocot structure; and wherein the shed weighs less than about 300 lbs.

19. An agricultural barn or warehouse as recited in claim 11, the foam body further comprising a pre-cut slot in a first face of the panel, the pre-cut slot being centered on a respective channel, extending through the first face into the channel, the foam body further comprising a score line or pre-cut slot in an opposite second face of the panel, aligned with a corresponding pre-cut slot in the first face, such that the thickness of the foam beneath the score line or adjacent the pre-cut slot in the second face is less than half the thickness of the foam body as defined between the first face of the panel and the opposite second face of the panel.

20. An agricultural barn for housing cattle or other animals, or a warehouse comprising:

a floor;

walls extending upward from the floor, comprising foam wall panels covered over with a wainscot of impact panels to provide the wainscot portion of the wall with impact resistance;

a roof assembly over the walls, the roof assembly including roof trusses with foam roof panels attached between adjacent members of the roof trusses;

wherein the (i) impact panels of the wainscot portion of the wall, (ii) a remaining portion of the wall above the wainscot portion to the roof assembly, and (iii) an interior face of the foam panels of the roof assembly are coated with a polymeric, abrasion resistant, and impact resistant seamless coating that seals the interior space defined between the floor, the walls, and the ceiling in a seamless, air-tight configuration such that the walls, floor, and ceiling of the interior space can be washed down as needed, without leaking or otherwise causing damage;

wherein the walls are constructed using a system of modular foam panels and splines, wherein the modular foam panels comprise:

a foam body;

a plurality of channels extending through a length of the panel, each channel being configured to receive a spline therein, wherein each spline once received in the channel is disposed within the body, without the spline being exposed on an outside face of the body, so that the spline is restrained once received within the channel;

wherein the foam body is generally rectangular in shape with a plurality of channels disposed therethrough, with an I-beam positioned between adjacent panels, the splines in the channels being flanges of the I-beam.

21. An agricultural barn or a warehouse as recited in claim 20, wherein the plurality of channels extend horizontally through the length of the panel, the plurality of channels including one or more top channels and one or more bottom channels, each channel receiving a flange of an I-beam therein, wherein each flange of the I-beam once received in the channel is disposed within the body, without the flange being exposed on an outside face of the body, so that the flange is restrained in the channel.

22. An agricultural barn or a warehouse as recited in claim 20, wherein the plurality of channels include first and second top channels extending horizontally through the length of the foam body, and the plurality of channels include first and second bottom channels extending horizontally through the length of the foam body, wherein each of the top and bottom channels are configured to receive a flanges of respective I-beams therein, with a web center portion of the I-beam member positioned on the foam body between the flanges.

* * * * *